US008408249B2

(12) United States Patent
Lörup

(10) Patent No.: US 8,408,249 B2
(45) Date of Patent: Apr. 2, 2013

(54) WEAVING MACHINE WITH MODULARIZED DRIVE

(75) Inventor: Christian Lörup, Mellbystrand (SE)

(73) Assignee: TEXO AB, Almhult (SE)

( * ) Notice: Subject to any disclaimer, the term of this patent is extended or adjusted under 35 U.S.C. 154(b) by 120 days.

(21) Appl. No.: 13/140,278

(22) PCT Filed: Dec. 4, 2009

(86) PCT No.: PCT/SE2009/000506

§ 371 (c)(1),
(2), (4) Date: Jun. 16, 2011

(87) PCT Pub. No.: WO2010/071536

PCT Pub. Date: Jun. 24, 2010

(65) Prior Publication Data

US 2011/0247716 A1 Oct. 13, 2011

(30) Foreign Application Priority Data

Dec. 16, 2008 (SE) ..... 0802577

(51) Int. Cl.
*D03D 51/02* (2006.01)
*D03C 13/00* (2006.01)
*D03D 51/00* (2006.01)

(52) U.S. Cl. ..... 139/11; 139/1 E; 139/56; 139/87; 139/449

(58) Field of Classification Search ..... 139/1 E, 139/11, 35, 55.1, 56, 82, 87, 116.1, 449, 139/188 R See application file for complete search history.

(56) References Cited

U.S. PATENT DOCUMENTS

| | | | | | |
|---|---|---|---|---|---|
| 3,373,773 | A | * | 3/1968 | Balentine, Jr. et al. | 139/1 R |
| 3,570,550 | A | * | 3/1971 | Budzyna | 139/336 |
| 3,664,383 | A | * | 5/1972 | Minchey et al. | 139/317 |
| 4,111,240 | A | * | 9/1978 | Mallard | 139/449 |
| 4,195,671 | A | * | 4/1980 | Bossut | 139/455 |
| 4,416,310 | A | * | 11/1983 | Sage | 139/59 |
| 4,440,196 | A | * | 4/1984 | Arvai | 139/59 |
| 4,739,806 | A | * | 4/1988 | Palau et al. | 139/455 |
| 4,844,130 | A | * | 7/1989 | Blontrock | 139/92 |
| 4,974,641 | A | * | 12/1990 | Yarita et al. | 139/245 |
| 5,069,256 | A | * | 12/1991 | Goodman, Jr. | 139/83 |

(Continued)

FOREIGN PATENT DOCUMENTS

| | | | |
|---|---|---|---|
| DE | 10318818 | A1 | 11/2004 |
| DE | 102005039738 | A1 | 3/2007 |

(Continued)

OTHER PUBLICATIONS

"PCT International Search Report dated Mar. 25, 2010 for PCT/SE2009/000506, from which the instant application is based," 4 pgs.

*Primary Examiner* — Bobby Muromoto, Jr.
(74) *Attorney, Agent, or Firm* — Fredrikson & Byron, P.A.

(57) ABSTRACT

A weaving machine with drive elements including two or more crankshaft parts rotatable along the width direction of the machine and a common rotational center line. The drive elements are situated in intermediate sections and include respectively a lay sword and lay sword shaft and are connected to a connecting rod belonging to the intermediate section. The machine utilizes a computerized control system for controlling the weaving process. Substantial weight and space reductions are made as large, heavy shaft mountings and gearboxes can be avoided.

17 Claims, 7 Drawing Sheets

U.S. PATENT DOCUMENTS

Figure 1:
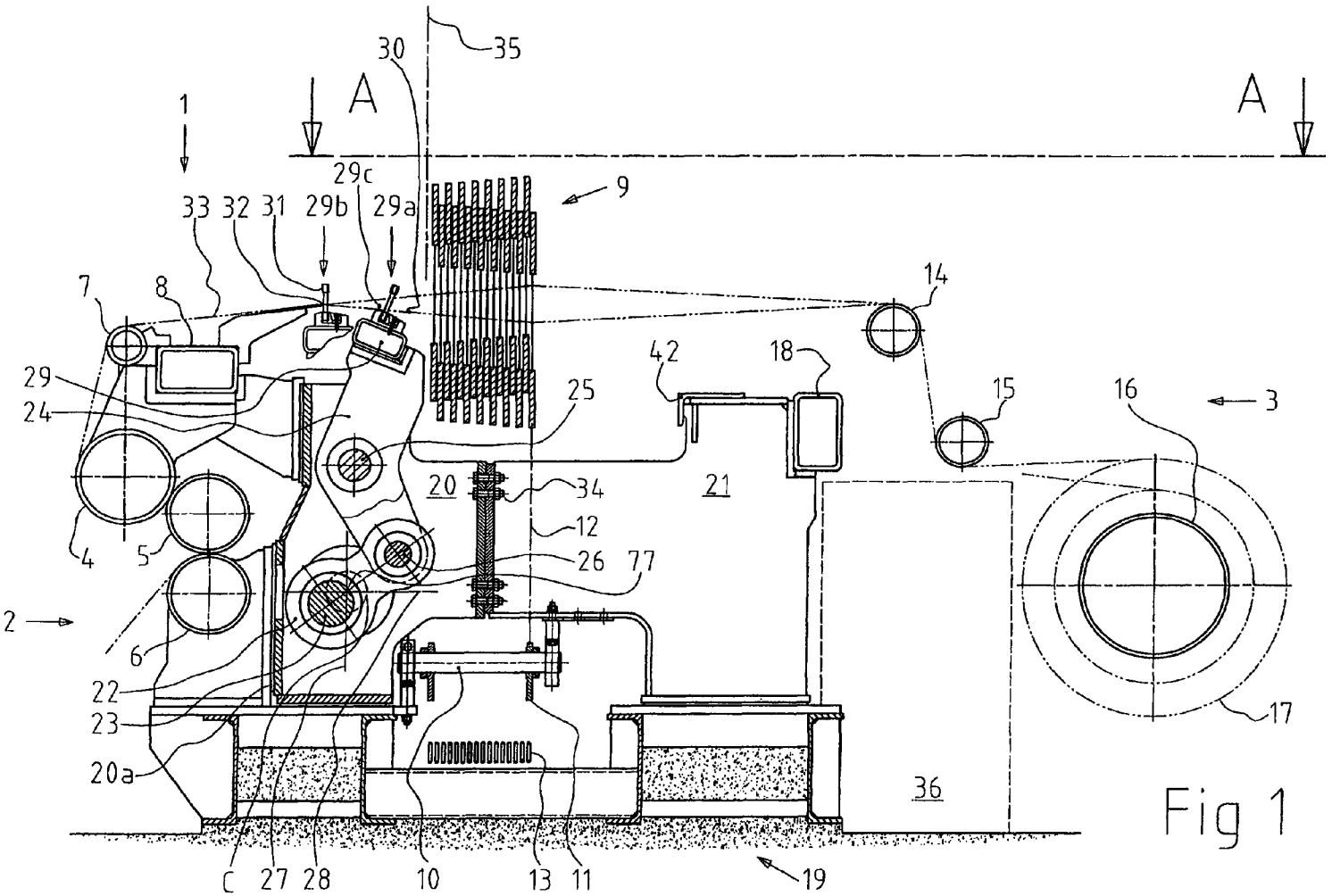

| | | | | |
|---|---|---|---|---|
| 5,274,894 | A * | 1/1994 | Wilhelm et al. | 28/202 |
| 5,839,482 | A * | 11/1998 | Vestby et al. | 139/456 |
| 5,927,347 | A * | 7/1999 | Palau et al. | 139/65 |
| 6,026,864 | A * | 2/2000 | Corain et al. | 139/449 |
| 6,418,972 | B2 * | 7/2002 | Krumm et al. | 139/188 R |
| 6,460,577 | B1 * | 10/2002 | Krumm | 139/57 |
| 7,178,558 | B2 * | 2/2007 | Nayfeh et al. | 139/11 |
| 7,231,943 | B2 * | 6/2007 | Svensson | 139/116.1 |
| 7,318,456 | B2 * | 1/2008 | Nayfeh et al. | 139/11 |
| 2001/0003994 | A1 * | 6/2001 | Mansson | 139/1 R |
| 2001/0042570 | A1 * | 11/2001 | Krumm et al. | 139/188 R |
| 2002/0069927 | A1 * | 6/2002 | Bryn et al. | 139/48 |
| 2002/0124901 | A1 * | 9/2002 | Krumm | 139/57 |
| 2004/0055658 | A1 * | 3/2004 | Natali et al. | 139/327 |
| 2004/0261881 | A1 * | 12/2004 | Svensson | 139/55.1 |
| 2005/0103394 | A1 * | 5/2005 | Bassi et al. | 139/59 |
| 2005/0194055 | A1 * | 9/2005 | Volpi et al. | 139/55.1 |
| 2006/0249217 | A1 * | 11/2006 | Nayfeh et al. | 139/11 |
| 2007/0107796 | A1 * | 5/2007 | Nayfeh et al. | 139/11 |
| 2007/0293976 | A1 * | 12/2007 | Puget et al. | 700/140 |
| 2008/0099095 | A1 * | 5/2008 | Krumm et al. | 139/188 R |
| 2011/0259465 | A1 * | 10/2011 | Schaub | 139/29 |

FOREIGN PATENT DOCUMENTS

| | | | |
|---|---|---|---|
| EP | 1775361 | A2 | 4/2007 |
| FR | 2790269 | A1 | 9/2000 |
| JP | 2080644 | A | 3/1990 |
| SE | 508237 | C2 | 9/1998 |
| SE | 510772 | C2 | 6/1999 |
| SE | 522719 | C2 | 3/2004 |
| WO | 2006032233 | A1 | 3/2006 |
| WO | 2007022856 | A1 | 3/2007 |

* cited by examiner

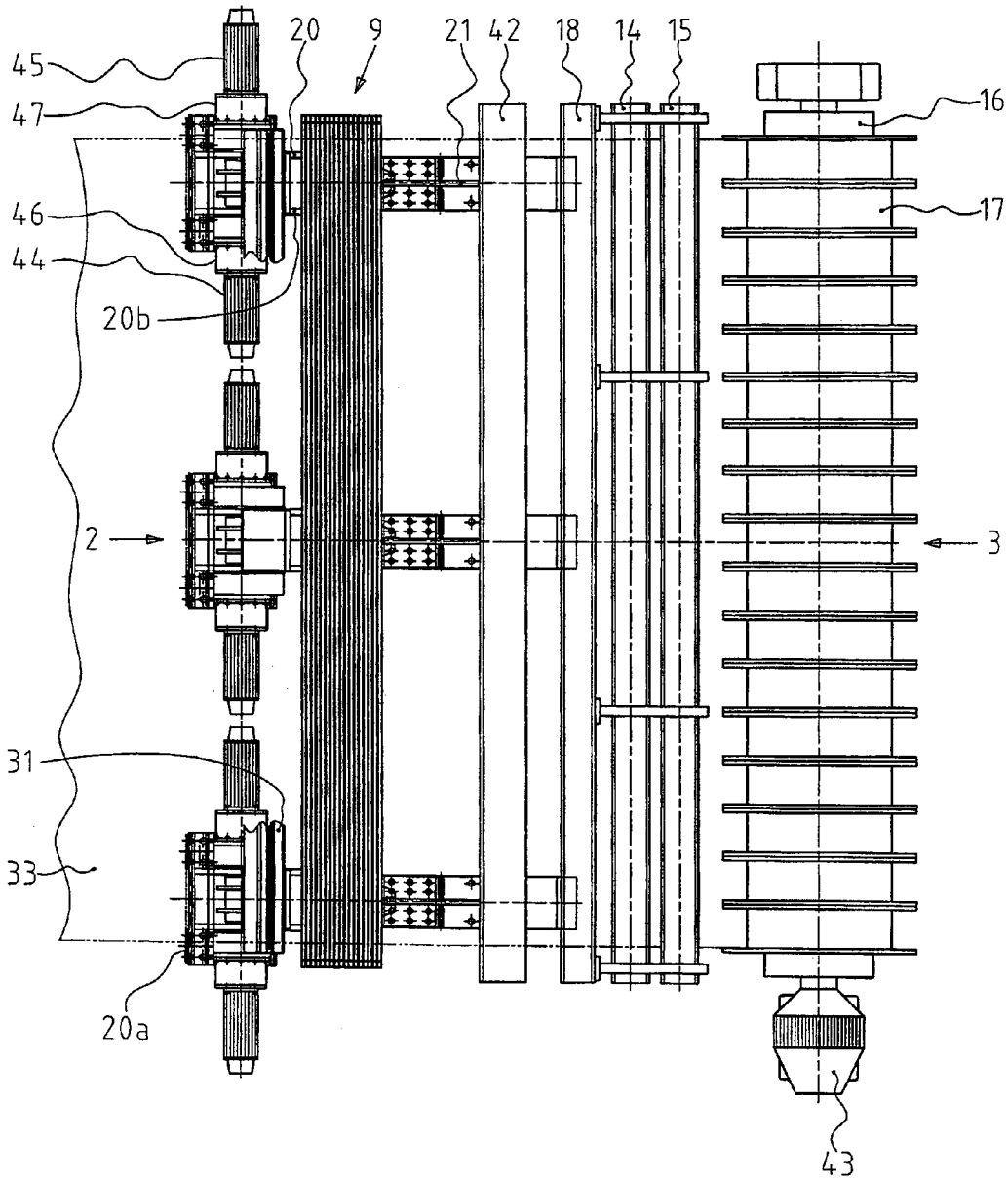
Fig 3 (A-A)

WEAVING MACHINE WITH MODULARIZED DRIVE

RELATED APPLICATIONS

This application is a 35 U.S.C. 371 national stage filing from International Application No. PCT/SE2009/000506 filed Dec. 4, 2009 and claims priority to Swedish Application No. 0802577-7 filed Dec. 16, 2008, the teachings of which are incorporated herein by reference.

The present invention relates to a weaving machine comprising a lay beam which by means of drive elements is movable between a rear position, in which the introduction of the weft thread into a warp arrangement can be realized, and a front position, in which a beat-up against a beating-up edge of the respective introduced weft thread can be effected.

Weaving machines of this type are previously known and reference can be made, inter alia, to the weaving machines marketed by the Applicant for the present patent application, TEXO AB, Sweden, under the designations TCR (TransCent Rapier) and TM, which are utilized for the production of wire. Compare SE 522719, SE 510772 and SE 508237.

Present drive systems for a wide weaving machine having a large number of inner stands (intermediate sections) consist of a thick and heavy main shaft (crankshaft) with couplings which couple together all the intermediate sections along the whole of the weaving width. The intermediate sections are in this way mechanically coupled and all join together in a synchronized rotary motion. At both outer ends of the machine, on each side, are seated an AC motor and a reduction gear.

There is a general aim to obtain simplifications and increased effectiveness in the construction and working of the weaving machine. For instance, there may be a desire for the weaving machine to be able to be made up of easily assembled modules or sections producible in lightweight material. Long, heavy elements should be able to be eliminated. Components with lower inertias should be able to be utilized. If so desired, higher weaving/pick speeds should be able to be achieved. More exact controls of the weaving process are often an expressed wish, as well as less critical functions. Fewer and more easily handleable parts and greater visual supervision and improved access into the weaving machine and its interior are often high on the list of requirements. There is also a desire for the modules and components of the weaving machine to be able to be standardized and for the ideas behind the invention to be implemented in the production process of the weaving machine and as complements to pre-existing weaving machines. The hitherto major adjustment requirements between the different parts of the known weaving machines should be able to be substantially minimized.

The object of the present invention is to solve the whole and parts of the specified problems, with the principal aim of achieving simplifications in the construction and working of the weaving machine. The drive system according to the invention is constructed such that each intermediate section is driven with at least one AC servo motor in a synchronized rotary motion. The one or more motors drive via a reduction gear preferably a short and light crankshaft, which in one embodiment makes one turn upon each starting occasion. Alternatively, if a mechanical arrangement is used for the purpose, only half a turn is performed with each beat-up. Once the band gripper (alternatively the shuttle, the projectile, etc.) has drawn a thread over the weaving width, the drivings of the sections commence and the crank makes a turn, i.e. shoots in the thread lying in the shed and then returns to the rear position ready for a new thread to be able to be drawn in. This drive system can be termed intermittent or sequential—once a motion is concluded, the next stage is started. The advantage with this drive system is that many large and heavy components are able to be removed and that the number of constituent components is minimized.

A weaving machine according to the invention can primarily be deemed to be characterized in that the drive elements comprise two or more crankshaft parts which turn or rotate along the width direction of the weaving machine and according to a common rotational center line. The crankshaft parts are situated in stands comprising modules or sections, here termed intermediate sections, which respectively also comprise a lay sword which is mounted rotatably on a lay sword shaft and is connected to a connecting rod belonging to the respective intermediate section. The intermediate section comprises at least one individual motor turning the crankshaft part of the intermediate section part and the weaving machine also comprises or is connected to a control system provided with a rotary motion control unit and arranged to control, via amplifying elements, the motors of the intermediate sections for mutual synchronous rotary motion of the crankshaft parts of the various intermediate sections.

In refinements of the inventive concept, the control system can comprise a computerized main control system comprising or connected to a master motion control unit, which in turn is connected to servo amplifiers forming part of the intermediate sections and connected to motors in the form of servo motors provided with reduction gears. The respective stand can comprise double walls, in which the crankshaft and lay sword shaft of the intermediate section are mounted on the inner sides of the walls. The respective motor which drives the crankshaft can be mounted on the wall in question on the outer side thereof. The lay sword and connecting rod of the respective intermediate section are mounted in front of a vertical plane extending in front of the shaft frames of the weaving machine. The stand can comprise a double-walled front part and a rear single-walled part, connected to the latter and extending rearward, which parts can be connected to one another via bolted joints. The lengths in the depth direction can be adjusted to the number of shaft frames with which the machine is wished to be provided. Both walls in the double-walled stand or the stand part can be provided with servo motors extending on the outer sides of the walls and provided with reduction gears. One wall in the double-walled stand or stand part can alternatively be provided with two servo motors extending on the wall side in question and provided with their own respective reduction gear. The weaving machine can have a weaving width of 2-35 meters, preferably 5-15 meters, and the number of sections is 2-25, preferably 4-10. The time for the introduction of the weft thread and stoppages, or substantial stoppages, in machines of, for example, 15-meter width is about 400 ms, and the time for a motion, brought about by the drive elements, from said stoppages and for the beat-up against the beating-up edge is about 200 ms. Said times are dependent on the width of the machine and are therefore lower in machines below 15 meters and higher in machines above 15 meters. The control system is arranged to determine and/or vary said time for the beat-up of the weft thread, as well as preceding and following stoppage times, in dependence on the effects. The motors preferably have small internal inertias, for example about 0.003 $kgm^2$, and the weaving machine can operate, if so desired, at high pick speeds, for example 100-150 picks/min, including with high weaving machine widths of up to 15 meters. The crankshaft in the respective section preferably has a short length, for example 0.5-1.0 meter, and the crankshafts of the sections are situated 1-2 meters apart. The servo motors can be constituted by electric, hydraulic or pneumatic motors.

The modular unit per se can function in different contexts without being bound to the actual construction of the weaving machine. The modular unit is characterized by a double-walled stand or stand part, within which the crankshaft part is disposed and on which one or more motors for the crankshaft part are placed, together with a reduction gear, preferably via a mounting.

The above-stated provides a solution both to the specified main problem and to consequential problems arising therefrom. The sections can have substantially identical constructions, which substantially facilitate the adjustment between the sections. The crankshaft part in the respective section can weigh about 10 kg/meter, which represents a relatively small flywheel mass. The stand or stand parts and the motor/motors are low-weight and together weigh, for example, about 50-100 kg. A continuous shaft extending along the full width of the weaving machine can be avoided, as well as mountings and gearboxes for this. In this context, it can be pointed out that present continuous rotary shafts have 100 mm diameter with homogeneous construction, which implies weights of about 65 kg/meter. Added to this are the weights of the mountings and the gearboxes. Through the division of such a shaft into short and mutually spaced shafts in the sections, interspaces and crawl spaces appear, moreover, between the shafts, which increase access during installation and servicing of the machine. If so desired, it is also possible to exchange real angle transmitters for virtual angle transmitters integrated in the control function of the electronic unit, which can comprise and/or interact with a computer unit (PC). The electronic unit can also comprise microcomputers (CPU). The operational advantages are pronounced. The pick speed can be chosen, for example, at 150-250 picks/min, and the times for thread feed-in of the weft thread and beat-up can be optimized. The lay beam can be allotted an absolute stoppage position or a less oscillatory or lesser motion which is kept within the acceptable limit.

Figure 2:
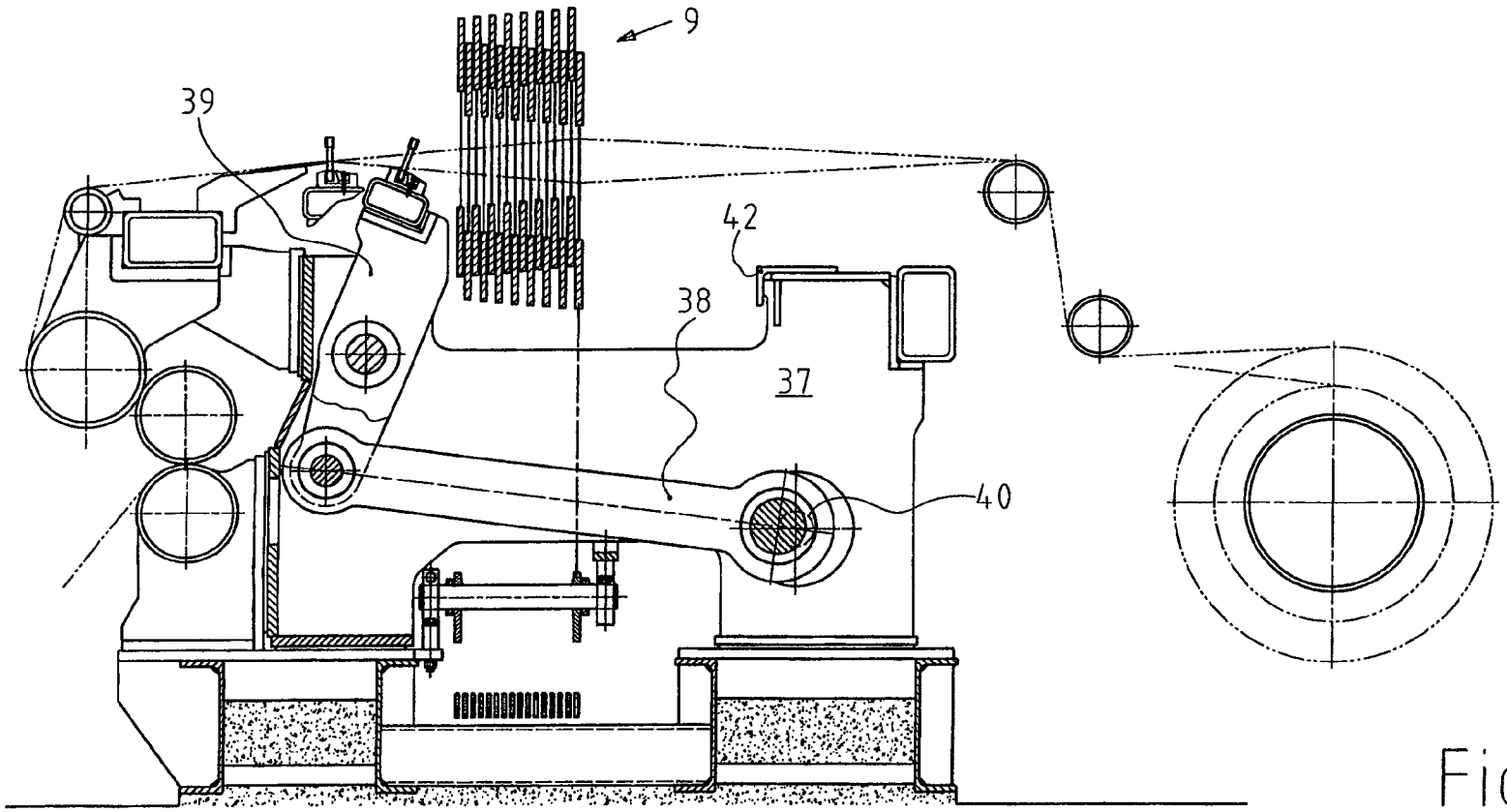
Figure 4A:
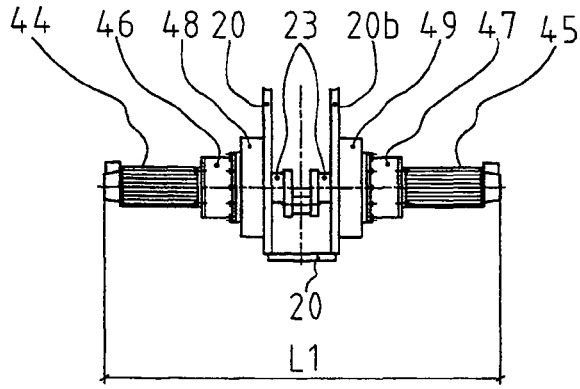
Figure 4B:
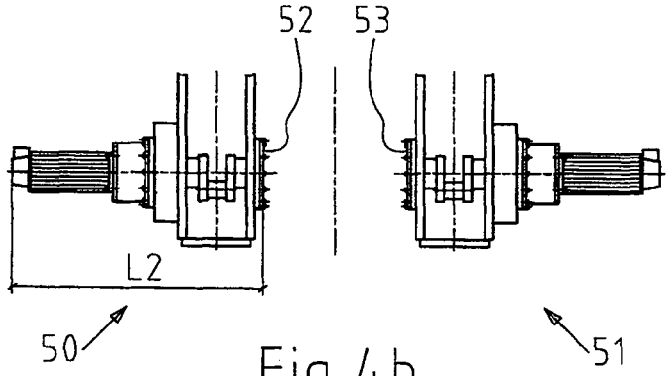
Figure 4C:
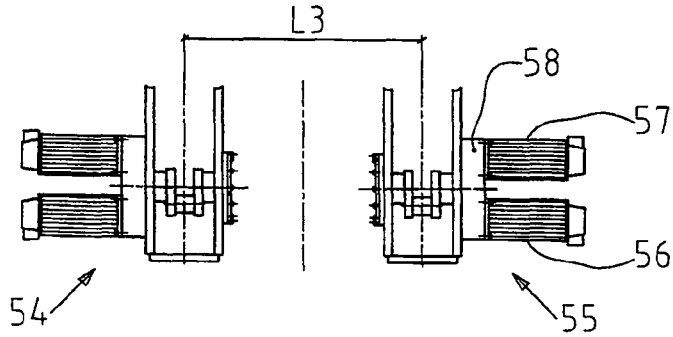
Figure 4D:
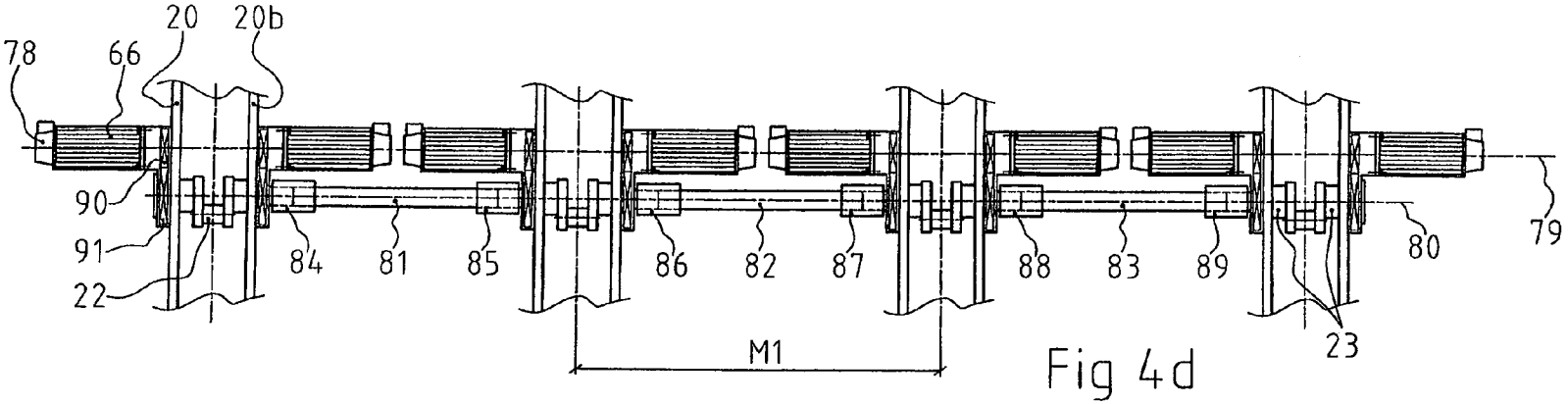
Figure 4E:
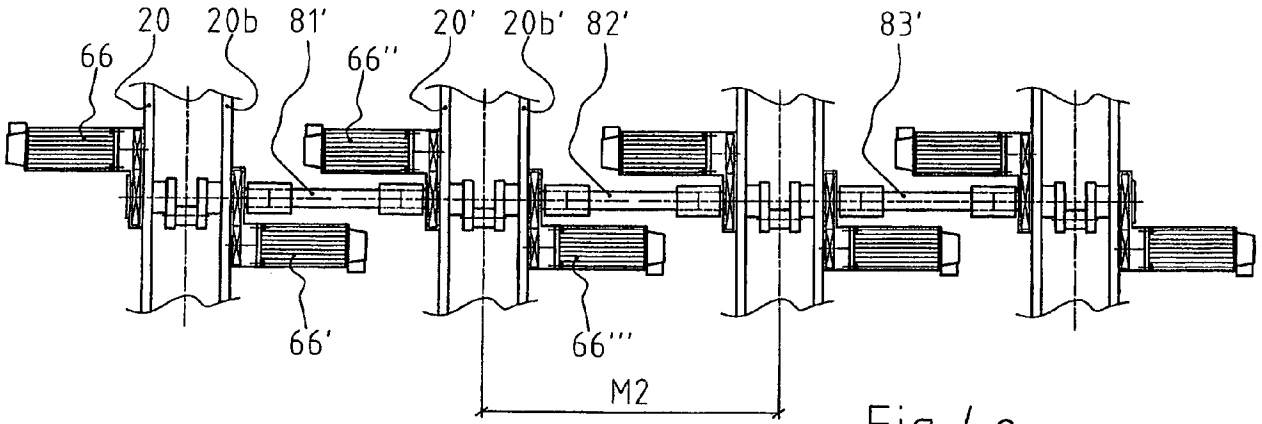
Figure 5:
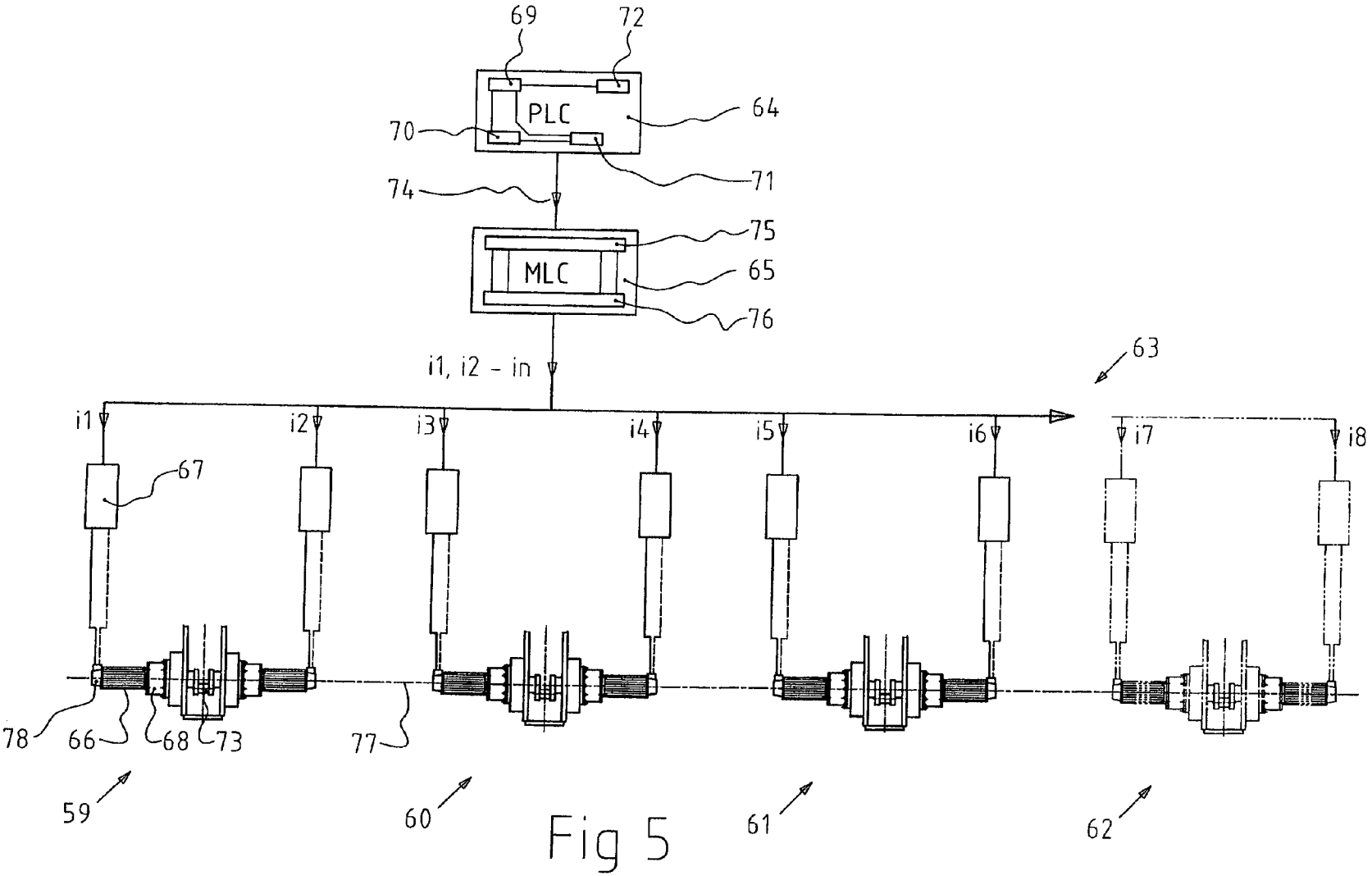
Figure 6:
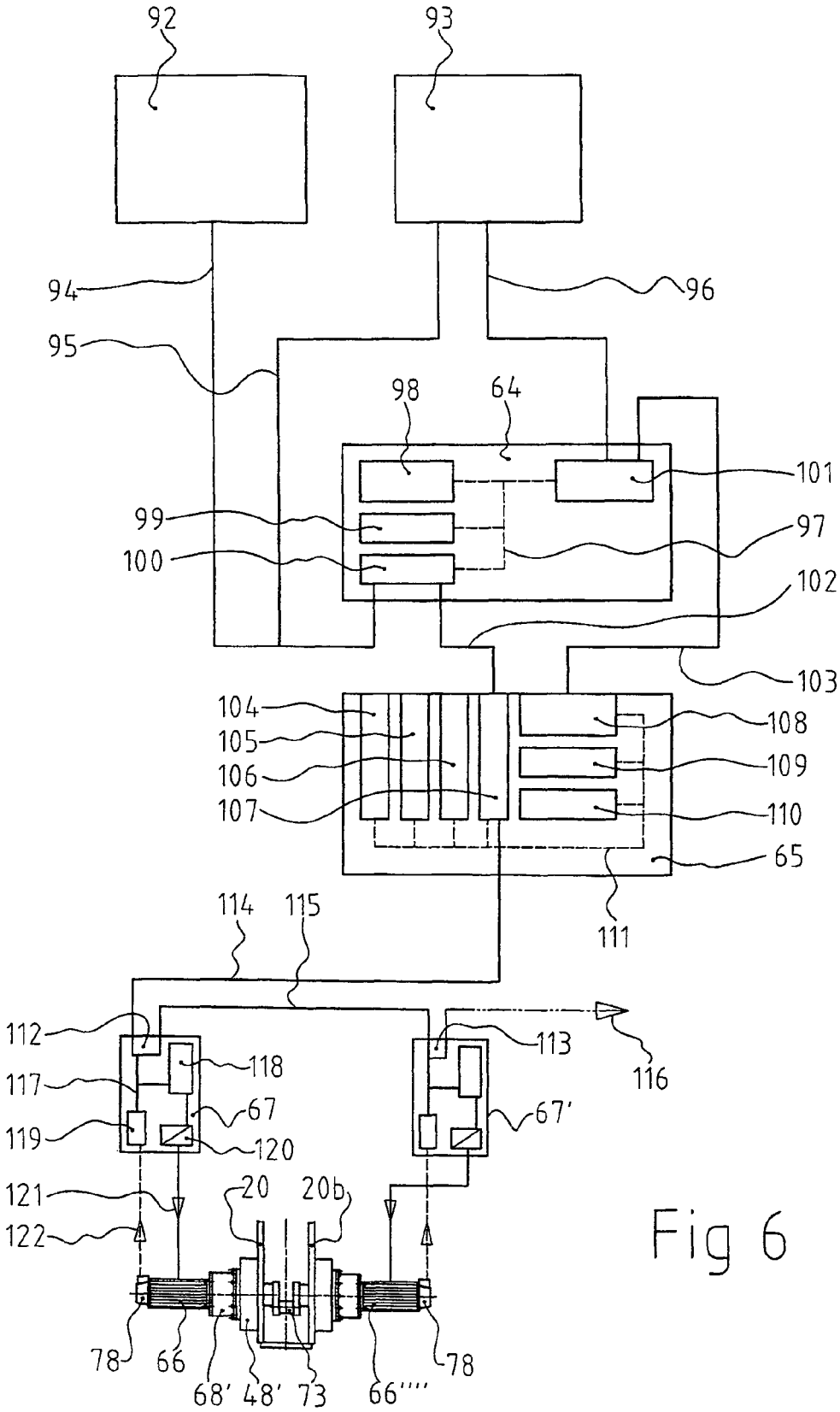

A currently proposed embodiment which has the distinctive features indicative of the invention shall be described below with simultaneous reference to the appended drawings, in which FIG. 1 shows an intermediate section in the cross section of the weaving machine in the depth direction, in which the drive has been placed between the cloth beams and the shaft frames, FIG. 2 shows an intermediate section of an alternative embodiment in the depth direction, in which the drive has been placed in the space behind the shaft frames, FIG. 3 shows a view A-A of the weaving machine according to FIG. 1, FIGS. 4*a*-4*e* show alternative motor placements from above, FIG. 5 shows schematically the control and monitoring of the weaving machine by means of a control system, and FIG. 6 shows schematically parts of the construction according to FIG. 5 in greater detail.

It can be seen from FIG. 1 that in the center of rotation there is a crankshaft, which with a pushing connecting rod effects the beat-up against the weave edge. By placing the drive in front of the shaft frames, ease of access into the machine for servicing and the accessibility to the lifting bars of the shaft frames in the event of rapid warp change, when reed, shaft frames and varp beam are lifted out of the machine and replaced with a new, prepared set, are increased. With this construction, the intermediate section is much simplified. In that part of the section in which the weave is mounted, the stand is double-walled. This part extends rearward toward the warp beam to a vertically machined plane in which a single-walled stand is screwed on and forms a complete stand (intermediate section). The machining for the mountings of the crankshaft and of the lay sword shaft can be effected with great accuracy, since they are made in the same arrangement. The desire has arisen for a large number of shaft frames to be put in the machine. With this cross section, this desire is easily satisfied by replacing the rear single-walled stand part with one of greater depth. Above all, the part with the drive always remains the same. In FIG. 2 is shown a section with the drive in the traditional place, i.e. behind the shaft frames. With this placement, the connecting rod is pulling during the beat-up. This system can perhaps be used in the conversion of existing machines. With this solution, the intermediate section is of an alternative appearance with double stand sides. In FIG. 3, a machine having three intermediate sections is shown from above. Each intermediate section has two drive sections, which drive the sections via reduction gears. Also apparent from the figure is the free space between the sections for servicing and decoupling of the shaft frames in the event of a warp change, which makes it comfortable and accessible. In order to illustrate the working, breast beam and cloth beam system have been removed. In FIG. 4*a*, single-motor operation is shown, in which the motor can be placed on one side or other of the intermediate section. FIG. 4*b* shows double-motor operation with a motor on each side of the intermediate section. FIG. 4*c* shows double-motor operation with both the motors mounted on a common reduction gear. This arrangement can be fitted on one or the other side of the intermediate section. FIG. 5 shows that the machine can be controlled from a PLC, which is the primary control system and is monitored by a "Motion Controller" MLC. A servo amplifier is fitted before the respective servo motor. The servo motors drive the crankshaft via a reduction gear on which each motor is mounted. The drive system according to the invention represents a flexible way of controlling a weaving machine. In the new system, it is easy to adjust pick speeds, it is easy to inch, the construction is simplified with few constituent components, and the ease of access for servicing and maintenance is substantially improved compared with previous systems.

In FIG. 1, a weaving machine for weaving wire is shown with 1, its front part being indicated with 2 and its rear part with 3. At the front there are suspended three cloth beams 4, 5 and 6, as well as a breast beam 7. A breast beam bar is shown with 8. In the central part of the weaving machine, viewed in the depth direction, shaft frames 9 are arranged. On a lever shaft 10 are mounted levers 11 for the maneuvering of shaft frames. In addition, push rods are included, which are indicated symbolically with 12. Pull rods for shaft frame maneuvering are indicated symbolically with 13. On the rear parts of the machine, viewed in the depth direction (to the right in FIG. 1), are arranged auxiliary beams 14 and 15 and a warp beam 16 with bobbins 17. A stand bar is shown with 18 and a base plate is indicated with 19. Described components are previously known in terms of construction and working and reference is made to the abovementioned known weaving machines.

According to the invention, the weaving machine comprises a number of stands arranged side by side in the width direction, i.e. at right angles to the figure plane for FIG. 1, which stands can be deemed to form sections/intermediate sections in the width direction of the weaving machine. The respective stand/unit can be produced separately and fitted as a unit/modular unit in the weaving machine during reconstruction or applied as an exchange module in already finished and/or used/delivered weaving machines which are provided with heavy and solid components in the form of crankshaft, gears and mountings for this, etc., extending in the full width direction of the weaving machine.

The stand/unit acting as a module/exchange module has double walls or wall parts, between which a connecting rod is mounted in wall recesses. The connecting rod in a stand 20, 21 is indicated with 22. The connecting rod has mounting shafts 23, by means of which the connecting rod is mounted in said wall recesses. The connecting rod is connected to an, in this embodiment, elbow-shaped lay sword 24, which is mounted between the walls of the stand, in recesses in these, by means of a lay sword shaft 25. The mounting of the connecting rod 22 in the lay sword is realized on the lower parts thereof and are indicated with 26. The center of rotation of the crankshaft lies at the point of intersection between indicated coordinate axes 27 and 28. The rotary motion is shown with a circle C. The crankshaft has a very short extent in the width direction of the weaving machine (for example 1-2 meters). The lay sword is connected at the top to the lay beam 29 of the weaving machine, which is actuable/movable between a rear position, see the position 29*a* indicated with unbroken lines, and a front position, see the position 29*b* indicated with dashed lines. In the rear position, a weft thread 29*c* is pulled in or pushed in with, for example, a shuttle or projectile, at right angles to the figure plane, between the shed 30 realized by the shaft frames. It is important that the shed is open and the lay beam is stationary or substantially stationary during the above-specified times. The lay beam has a reed/reed part 31, which, in the front position, actuates the weft thread against a beat-up edge 32 in the woven part 33 of the weave or cloth which is guided by and collected on the breast beams.

As is shown in FIG. 1, the stand can comprise a double-walled stand part 20 and a single-walled stand part 21 fastened to the latter. The fastening together of the stand parts is achieved by means of bolted joints 34. Alternative fastening together can be effected with glue, welding, etc. This version is utilized in the case shown. The crankshaft is placed in front of the shaft frames or in front of a vertical plane 35 extending at right angles to the figure plane. At the front, the double-walled stand part is fastened in the weaving machine stand via flanges 20*a*, which are indicated with sectioned lines.

The embodiment according to FIG. 1 allows a conspicuously large crawl space 36 to be obtained in the rear parts of the machine, which facilitates access to and servicing of the inner parts of the machine. Likewise, the work during normal operation, for example shaft frame and varp thread changes, is facilitated. The connection or joint 34 between the stand parts can be shifted rearward (to the right in FIG. 1) should one wish to increase the number of shaft frames, and vice versa.

In FIG. 2 an alternative embodiment is shown, in which the whole of the stand 37 is double-walled. The connecting rod 38 extends below and behind the shaft frames 9. In this embodiment, the lay sword 39 is straight (not elbow-shaped). The mounting between and in the walls of crankshaft and lay sword is realized in corresponding manner to that in the embodiment according to FIG. 1. In FIG. 2, the rotation circle is indicated with 40.

In FIG. 3, the double-walledness 20, 20*b* of the front stand part and the single-walledness 21 of the rear stand part can be seen. The stand part 21 is anchored to the frame of the weaving machine by means of bolted joints 34 (see FIG. 1). An L-iron-shaped holding bar in the weaving machine frame is shown with 42, and the fastening of the stand part to this bar can be done by means of screws, glue, welding, etc. The drive motor of the warp beam is shown with 43. In the shown illustrative embodiment, the respective stand is provided with two servo motors 44 and 45, which, via their respective reduction gear 46 and 47, jointly drive the crankshaft (see 23 in FIG. 1). The respective servo motor with its associated reduction gear is mounted in a recess on the outer side of the wall in question and is coupled to the two shaft journals of the crankshaft in order, jointly with the second servo motor and its reduction gear, to drive the crankshaft in the stand in dependence on control signals. The lay sword is mounted in the double walls in corresponding manner to the crankshaft/crankshaft parts.

FIG. 4*a* shows the application of the motors according to FIG. 3. The respective motor with associated reduction gear, together with the respective crankshaft end, is mounted onto the particular wall 20 or 20*b* by means of a mounting 48 or 49. The mounting 48, 49 serves also as a holder for motor/gear and connecting rod. The distance between the walls is 1-2 meters, which gives a corresponding total length L1 of motors and stand which is 3-4 meters long in the particular direction of the crankshaft and its bearing journals. Just one motor with reduction gear may be appropriate in the case of the double-walled stand, as is indicated in FIG. 4*b*, which shows firstly a left-hand fitting 50, and secondly a right-hand fitting. On the wall not supporting the servo motor with associated gear and mounting, the respective assembly variant has a mounting 52 or 53. The length L2 is about half of L1.

So-called double-driving can alternatively be used, examples of which are shown by FIG. 4*c*. The double-driving is alternative to the embodiment according to FIG. 4*a* and is utilized when the distance L3 is so small that the last-named embodiment cannot be accommodated. FIG. 4*c* shows left-hand and right-hand assemblies 54 and 55, which can be similarly constructed with double motors 56, 57 and mountings and reduction gears 58 on one wall. By virtue of the mountings in a double wall, these can be realized relatively simply and with great accuracy as necessary.

A stand or a modular unit for implementation in a newly built weaving machine or a weaving machine which is undergoing alteration is thus characterized by a double-walled stand in which a crankshaft is mounted inside the stand, and the servo motor with reduction gear is mounted on the outer side of one stand wall in mountings. These distinctive features are independent of the rest of the working of the weaving machine.

FIGS. 4*d* and 4*e* show a case in which the crankshaft parts of the modules are mechanically coupled in order, together with the servo motors, to ensure a markedly synchronized or coordinated joint driving of the lay beam with modules which interact in the weaving situation. The embodiment is described in greater detail in the passage below.

It is important that the crankshafts in the stand or modular units which are set up side by side and are activated in the weaving situation can be synchronously driven for synchronous actuation of the lay beam. FIG. 5 shows an example of such synchronous driving. The number of modular units can be large, for example up to 30. In FIG. 5, a series of modular units have been shown with 59-62. The arrow 63 indicates the expansion and reduction facility. In the shown case, the modules are constructed according to FIG. 4*a* and can be identical or different in terms of their construction, compare FIGS. 4*b* and 4*c*. The servo motors of the modular units are controlled by means of a main control system 64, for example of the Omron type, which comprises or is connected to a master motion control unit 65 (Motion Controller), which can be of the Rexroth type. The respective servo motor 66 is connected to a servo amplifier 67, which, it too, can be of the Rexroth type. The reduction gear 68 of the servo motor can be of the Alpha type. The unit 64 has a CPU 69, memories 70, key set 71 and screen 72. On the unit, speeds and motional patterns of the crankshafts 73 can be keyed in, i.e. codes for, inter alia, authorized usage. The motional control unit 65 receives information 74 from the unit 64 in receiving circuits and, via generation circuits 76, transmits control signals $i_1$, $i_2$-$i_n$ to the modular units, the servo amplifiers of which, in dependence on these signals, effect coupling, decoupling, power driving etc. to the servo motors. A number of stands in the system can be activated or deactivated such that all stands, a group of stands or a single stand is/are selectively connected in the respective weaving situation. A non-activated stand or stands does/do not participate in the weaving function, but are idle in this. The signals can have different characters and, for example, can differ in terms of the number of pulses, levels, etc. The choice of the number of stands which are to be connected in the respective weaving situation is made in the respective choice or coupling stage, using, for example, the below-described key set, the voice-activated control system, etc. Alternatively, the number of stands can be determined with separate coupling and decoupling elements. The system operates with feedback functions, which in FIG. 5, for the sake of clarity, have not been indicated. The above-specified modular unit can also be characterized by connecting elements to the servo amplifiers, the unit 65 and/or the unit 64. The weights of the modular units can be made low, for example about 25 kg. The common center line of the crankshafts, about which rotation occurs and along which all crankshafts are arranged, has the notation 77 in FIGS. 1 and 5. The respective servo motor comprises a transmitter 78, which creates a feedback signal in dependence on the rotation of the servo motor.

FIG. 4*d* shows a weaving machine with coupling together of the crankshaft parts of the crankshafts. In this case, the servo motors are arranged such that their longitudinal axes coincide with a common center line 79. The mounting shafts 23 of the crankshaft parts are arranged along a further center line 80 parallel with the center line 79. The last-named center lines extend in the width direction of the weaving machine. The respective servo motor 66 is provided with a transmitter 78. The crankshaft parts of the modules are mutually connected with mechanical crankshafts 81, 82, 83, etc., which are connected to the crankshaft parts of the modules via couplings 84, 85, 86, 87, 88, 89, etc. In relation to the longitudinal drive shaft of the prior art, and its gearboxes, the total weight is reduced down to 15-25% with the aid of the drive by means of the servo motors 66 and the indicated shaft parts 81, 82 and 83. Moreover, the advantages with the fact that the arrangement according to FIG. 4*d* comprises a number of more easily accessible parts with lower weight are also obtained. The distances between the modular units or the stand parts are indicated with M1. The motors 66 drive the crankshafts via 22, 23 via gearwheel arrangements 90, 91 connected to the respective motor and the respective crankshaft.

FIG. 4*e* shows an arrangement in which the distance M1 can be reduced to 75-90%. The modular unit 20, 20*b* can here be arranged such that the motor 66 extending from the wall 20 is situated displaced in relation to the motor 66' extending from the wall 20*b*, which displacement can be in the order of 90-180°. With a corresponding arrangement for the motors 66" and 66'" on the modular unit 20' and 20*b'*, the motors 66' and 66" of the modular units concerned can extend partially side by side. With a similar arrangement of constituent modular units, the distance M1 between adjoining modular units can be shrunk to the distance M2, which can be 75-90% of the distance M1. The shaft parts 81', 82' and 83' can be reduced in length, and hence in weight, in relation to the shaft parts 81, 82 and 83 in FIG. 4*d*. Otherwise the arrangement according to FIG. 4*e* corresponds to that which is indicated in FIG. 4*d*.

In FIG. 6, a more detailed arrangement of, above all, the control system is shown. In this case, the main control system (PLC) 64 and the master motional control unit (MLC) 65 of the machine are shown in greater detail. In addition, the construction of the servo amplifiers 67, 67' is indicated in more detail. The control system has in this case been indicated in connection with the servo motors 66 and 66"" (compare also 44 and 66 in FIG. 4*a* and FIGS. 4*d* and 4*e* respectively) and the reduction gear of the servo motor has in this case been indicated with 68' (compare, inter alia, with 46 in FIGS. 4*a* and 68 in FIG. 5). The mounting of the servo motor 66 and of its reduction gear 68' in the stand 20, 20*b* has been indicated with 48' (compare with 48 in FIG. 4*a*). The transmitters of the servo motors 66, 66"" are shown with 78 and 78' respectively. The crankshaft of the stand 20, 20*b* has also been indicated in FIG. 6 with 73.

In the embodiment according to FIG. 6, an operator terminal 192 is included, which is constituted by an industrial PC (computer unit). In addition, an operator terminal II 93 is included, which can comprise actuating elements in the form of a key set, voice-activated control system, etc. The unit 92 is connected to a control terminal 64 via a connecting lead 94, and the unit 93 is connected to the control system 64 via leads 95 and 96. Alternatively, one or both of the units 92 and 93 can be integrated with the system 64. This can comprise one or more bus connections 97 for constituent units in the form of a PLC program unit 98, a memory 99 and a unit 100 for the connection and powering of field buses. In addition, analog and digital outputs 101 are included. The unit 100 is connected to the units 92 and 93 via the bus connections 94 and 95. The unit 101 is connected to the unit 93 via the connection 96. In addition, the units 100 and 101 are connected to the unit 65 via a bus connection 102 and the connection 103. The unit 65 can comprise a virtual master unit 104, a comparing element 105, a PLC program unit 106 and a field bus unit 107. Additionally included are an analog/digital converter 108, a memory element 109 and a parameter unit 110. The field bus unit 107 is connected to the field bus unit 100 in the control system 64 via the connection 102, and the converters 101 and 108 are connected to one another via the connection 103. The unit 65 also comprises an internal bus connection arrangement 111. The servo amplifiers 67, 67' can be identically constructed and comprise a receiving unit 112 or 113. The unit 112 is connected via RJ45 to the unit 65 via a field bus 114 of the SERCOS type. In the shown case, the various stands/modular units of the weaving machine are controlled in parallel. For this, the unit 112 is connected to the unit 113 via a connection 115. The unit 67 is connected in a corresponding manner via the receiving unit 113 to following servo amplifiers, etc. (not shown), as indicated with the arrow 116. The respective amplifier has internal connections 117. The respective amplifier comprises a control unit 118, a decoding interface 119 and a direct current/alternating current converter 120. The indicated alternating current 121 is a 3-phase alternating current and can have a voltage of 400 volt. The transmitters (Absolut type) 78, 78' transmit a signal 122, which is dependent on the rotation of the respective servo motor and is received in the interface 119.

The invention is not limited to the above-specified embodiment, but can be subject to modifications within the scope of the following patent claims and the description.

The invention claimed is:

1. A weaving machine comprising a lay beam which by means of drive elements is movable between a rear position, in which the introduction of the weft thread into a warp arrangement can be realized, and a front position, in which a beat-up against a beating-up edge of the respective introduced weft thread can be effected, wherein the drive elements comprise two or more crankshaft parts rotatable along the width direction of the weaving machine and according to a common rotational center line, in that the crankshaft parts are situated in stands comprising modules or intermediate sections, which respectively also comprise a lay sword which is mounted rotatably on a lay sword shaft and is connected to a connecting rod belonging to the module or the intermediate section, in that the module or the intermediate section comprises at least one individual motor turning the crankshaft part thereof, and in that the weaving machine comprises or is connected to a control system provided with or interacting with a rotary motion control unit and arranged to control, via amplifying elements, the motors of the intermediate sections for mutual synchronous rotary motion of the crankshaft parts of the various modules or intermediate sections.

2. The weaving machine as claimed in claim 1, wherein the control system comprises a computerized main control system connected to a master motion control unit, which in turn is connected to servo amplifiers forming part of the modules or the intermediate sections and connected to motors in the form of servo motors provided with reduction gears.

3. The weaving machine as claimed in claim 1, wherein the respective stand comprises double walls, in which the crankshaft and lay sword shaft of the module or intermediate section are mounted via mountings on the outer and/or inner sides of the walls, and wherein the respective motor which drives the crankshaft is mounted on the outer side of the wall in question.

4. The weaving machine as claimed in claim 1, wherein the lay sword and connecting rod of the respective module or intermediate section are mounted in front of a vertical plane extending in front of the shaft frames of the weaving machine.

5. The weaving machine as claimed in claim 4, wherein the stand comprises a double-walled front part and a rear single-walled part, connected to the latter and extending rearward.

6. The weaving machine as claimed in claim 5, wherein the front and rear parts are connected to one another via seam joints or bolted joints.

7. The weaving machine as claimed in claim 3, wherein both walls in the double-walled stand or the stand part are provided with servo motors extending on the outer side of the walls and provided with reduction gears.

8. The weaving machine as claimed in claim 3, wherein one wall in the double-walled stand or stand part is provided with two servo motors extending on the wall sided in question and provided with their own respective reduction gear.

9. The weaving machine as claimed in claim 1, wherein the weaving machine has a width of 2-35 meters, preferably 5-15 meters, and wherein the number of modules or sections, individual ones of which, a group of which or all of which can be activated or connected up in the respective weaving case in question, is 2-25, preferably 4-10.

10. The weaving machine as claimed in claim 1, wherein the time for the introduction of the west thread and stoppages, or substantial stoppages, in weaving machines of 15-meter width is 400 ms, and the time for a motion, brought about by the drive elements, from said stoppages and for the beat-up against the beating-up edge is 200 ms, and wherein the last-named times are lower given smaller widths of the weaving machines and higher given larger widths of the weaving machines.

11. The weaving machine as claimed in claim 1, wherein the control system is arranged to determine and/or vary said time for the beat-up of the weft thread, as well as preceding and following stoppage times, in dependence on the effects.

12. The weaving machine as claimed in claim 1, wherein the modules or the intermediate sections are identically constructed.

13. The weaving machine as claimed in claim 1, wherein the motors have small internal inertias, by which is meant inertias of about 0.0003 $kgm^2$.

14. The weaving machine as claimed in claim 1, wherein it operates at high pick speeds, for example 100-150 picks/min.

15. The weaving machine as claimed in claim 6, wherein the crankshaft in the respective module or intermediate section has a short length, for example 0.2-0.8 meter, and in that the crankshafts of the modules or intermediate sections are situated 1-2 meters apart.

16. The weaving machine as claimed in claim 1, wherein two, several or all of the crankshaft parts or modules or intermediate sections are coupled together with a shaft/shaft parts arranged to, by means of its/their rotary motions, form part of a markedly coordinate motional pattern of the lay beam, together with the servo motors of the modules or intermediate sections.

17. The weaving machine as claimed in claim 16, wherein in a vertical plane extending in the depth direction of the machine, the servo motors of the respective stand, which extend outward from the outer sides of the stand, have their longitudinal axes either coincidental with a common longitudinal axis in the width direction of the weaving machine, a first distance being obtained between adjoining modules or sections, or situated along two different longitudinal as in the width direction of the weaving machine, so that the servo motors in the various modules or intermediate section can extend partially side by side, a second distance being obtained which is less than the first distance.

* * * * *